US005245710A

United States Patent [19]

Haselswerdt et al.

[11] Patent Number: 5,245,710

[45] Date of Patent: Sep. 21, 1993

[54] FLUSH TOILET AND METHOD

[75] Inventors: Vernon W. Haselswerdt, Willits; John M. Mayfield, Jr., Ukiah, both of Calif.

[73] Assignee: Microphor, Inc., Willits, Calif.

[21] Appl. No.: 814,947

[22] Filed: Dec. 30, 1991

[51] Int. Cl.[5] ..... E03D 9/10; E03D 11/10

[52] U.S. Cl. ..... 4/319; 4/432; 4/435

[58] Field of Search ..... 4/319, 320, 328, 431, 4/432, 435

[56] References Cited

U.S. PATENT DOCUMENTS 3,698,019 10/1972 Culp ..... 4/431
3,720,962 3/1973 Harrah ..... 4/431
3,968,526 7/1976 Harrah ..... 4/420
4,156,297 5/1979 Pilolla ..... 4/319 X
4,561,132 12/1985 Lew et al. ..... 4/431 X
4,918,764 4/1990 Haselswerdt et al. ..... 4/406

*Primary Examiner*—Henry J. Recla
*Assistant Examiner*—Robert M. Fetsuga
*Attorney, Agent, or Firm*—Graham & James

[57] ABSTRACT

A toilet bowl has a discharge opening for flowing waste material into a gas-tight hopper. A waste valve is disposed between the discharge opening and the hopper for controlling the flow of waste material into the hopper. A first air valve selectively allows air to flow into the hopper for pressurizing the hopper and communicating the waste material from the hopper to the inlet of a grinder. The outlet of the grinder is coupled to a one-inch waste conduit which leads to a waste tank which may be disposed in any convenient location. A second air valve selectively allows air to flow into the waste conduit for pressurizing the waste conduit and forcing the waste at high velocity to the waste tank.

15 Claims, 1 Drawing Sheet

FLUSH TOILET AND METHOD

BACKGROUND OF THE INVENTION

This invention relates to flush toilets and, more particularly, to flush toilets which employ pressurized air to aid the flushing operation.

U.S. Pat. Nos. 3,986,526 and 3,720,962 provide examples of air-assisted flush toilets. These toilets typically comprise a bowl portion and a gas-tight base portion. Water is used to flush waste from the bowl, and a gas such as air is used to pressurize the base portion for conveying the waste through a waste conduit (typically a one and one-quarter inch or larger pipe) and into a waste tank located below the toilet. The air assist allows the toilets to perform the flushing operation with one to two quarts of water rather than the four to six gallons of water required for conventional toilets. As a result, the toilets may be installed on boats, trains, and other vehicles which have limited space. As such vehicles are further downsized or otherwise modified in a manner which restricts the space available for such amenities, improvements which remove restrictions on the size or location of the toilet and associated plumbing (including water and waste storage facilities) are welcome.

SUMMARY OF THE INVENTION

The present invention is directed to an air-assisted flush toilet which uses significantly less water than known toilets and which has fewer restrictions on the size and location of necessary plumbing. More specifically, the water needed to flush the toilet is reduced to 22 to 23 ounces of water, the pipe diameter of the associated waste conduit is reduced to less than one and one-quarter inch and the waste tank may be placed in any convenient location. In one embodiment of the present invention, a toilet bowl has a discharge opening for flowing waste material therefrom into a gas-tight hopper. A waste valve is disposed between the discharge opening and the hopper for controlling the flow of waste material into the hopper. A first air valve selectively allows air to flow into the hopper for pressurizing the hopper and communicating the waste material from the hopper to the inlet of a grinder. The outlet of the grinder is coupled to a one-inch waste conduit which leads to a waste tank which may be disposed in any convenient location. A second air valve selectively allows air to flow into in the waste conduit for pressurizing the waste conduit and forcing the waste at high velocity to the waste tank.

DETAILED DESCRIPTION OF THE PREFERRED EMBODIMENTS

Figure 1:
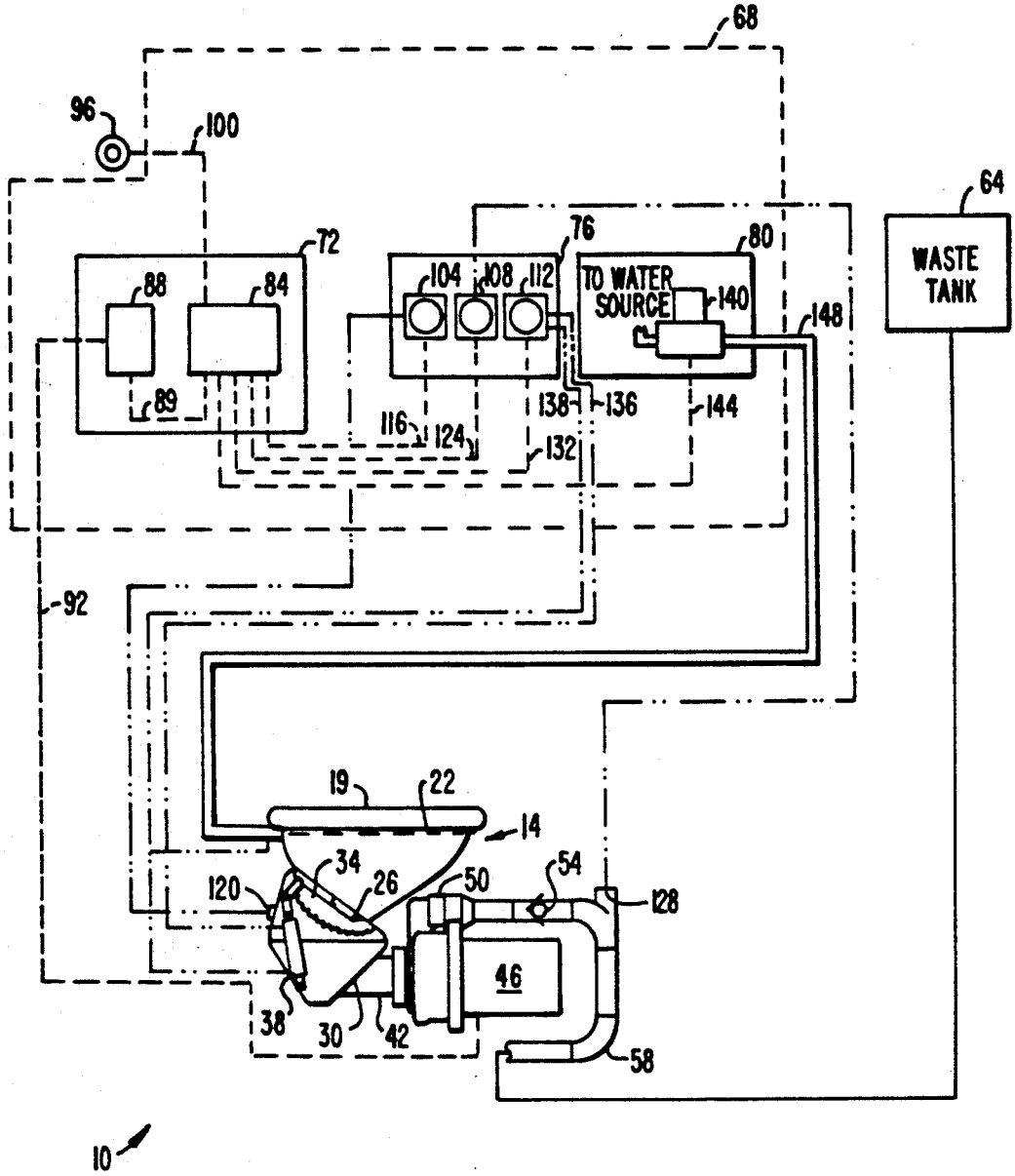
FIG. 1 is a partial schematic diagram of a particular embodiment of an air-assisted flush toilet according to the present invention.

FIG. 1 is a partial schematic diagram of a particular embodiment of an air-assisted toilet system 10 according to the present invention. Toilet system 10 includes a toilet 14 having a toilet bowl 18 which incorporates a water rinse ring 22 for flowing water into bowl 18. Toilet bowl 18 includes a discharge opening 26 for flowing waste material into a hopper 30. A waste valve 34, which is opened and closed by a double-acting air cylinder 38, is disposed between discharge opening 26 and hopper 30 for controlling the flow of waste material into hopper 30. Hopper 30 is coupled to an inlet 42 of a pump/grinder 46 for macerating the waste material. An outlet 50 of pump/grinder 46 is coupled to a waste conduit 58 through a check valve 54. In this embodiment, waste conduit 58 comprises a one-inch diameter pipe. Waste conduit 58 is coupled to a waste tank 64 which, in this embodiment, is located approximately five or more feet above toilet 14 to minimize the use of potentially unavailable space below toilet 14.

The operation of toilet 14 is controlled by a control unit 68 which includes an electrical control unit 72, an air control unit 76, and a water control unit 80. Electrical control unit 72 includes an electronic sequencer 84 and a motor starter 88. Electronic sequencer 84 controls the operational sequence of the other control units, and motor starter 88 supplies current to the motor of pump/grinder 46 over an electrical line 92. Electronic sequencer 84 is coupled to motor starter 88 through a line 89.

Air control unit 76 includes an air solenoid valve 104 for controlling pressurization of hopper 30, an air solenoid valve 108 for controlling pressurization of waste conduit 58, and an air solenoid valve 112 for controlling the operation of double-acting air cylinder 38. Air solenoid valve 104 is coupled to electronic sequencer 84 through a line 116 and to hopper 30 through an air conduit 120. Air solenoid valve 108 is coupled to electronic sequencer 84 through a line 124 and to waste conduit 58 through an air conduit 128. Air solenoid valve 112 is coupled to electronic sequencer 84 through a line 132 and to double-acting air cylinder 38 through air conduits 136 and 138.

Water control unit 80 includes a water solenoid 140 for supplying water from a water source (not shown) to toilet 14. Water solenoid 140 is coupled to electronic sequencer 84 through a line 144 and to water rinse ring 22 through a water conduit 148. Air conduit 138 from air solenoid 112 is coupled to water conduit 148 for reasons discussed below.

A flush button 96 is coupled to electronic sequencer 84 through a line 100 for initiating the operation of the various system components. Once flush button 96 is depressed, electronic sequencer 84 activates water solenoid 140 for supplying water to rinse ring 22 and thus to toilet bowl 18. After approximately one half of a second, air solenoid valve 112 is activated for supplying air to double-acting air cylinder 38 for opening waste valve 34 and for injecting air into water conduit 148. This allows toilet waste and rinse water to flow through discharge opening 26 and into hopper 30. The air injected into water conduit 148 increases the flush water pressure for improved bowl wash. After approximately five to six seconds, air solenoid valve 112 closes which, in turn, stops air injection into water conduit 148 and causes double-acting air cylinder 38 to close waste valve 34. Then, motor starter 88 supplies current to pump/grinder 46 for macerating the waste material in hopper 30, and water solenoid 140 closes for stopping the flow of water to rinse ring 22. Water solenoid 140 is timed so that approximately 22 to 23 ounces of water flows into toilet bowl 18. Since the water flow stops after waste valve 34 closes, water is left in toilet bowl 18 for the next user.

Air solenoid valve 104 then opens for injecting air into hopper 30. This pressurizes hopper 30 and facilitates the flow of waste material into inlet 42 of pump/grinder 46. The ground waste material thereafter passes through outlet 50, past check valve 54 and into waste conduit 58. Air solenoid valve 104 then closes, and motor starter 88 stops supplying current to pump/grinder 46. Air solenoid valve 108 then opens for injecting air into waste conduit 58. This pressurizes waste conduit 58 for closing check valve 54 and forcing the ground waste material at a high velocity through waste conduit 58 into waste tank 64 or some other waste collection device. The amount of time that air is supplied to waste conduit 58 is determined by the length of waste conduit 58.

Many advantages are produced by an air-assisted toilet system constructed according to the present invention. For example, the amount of water which must be stored in the vehicle for a particular trip is drastically reduced. Pump/grinder 46 ensures that most foreign objects that go through the discharge opening 26 are ground up and conveyed through waste conduit 58 without jamming or disabling the toilet. Pressurizing the waste conduit allows the waste material to be moved horizontally or vertically as conditions require, and the waste tank may be located wherever it is convenient. Since waste conduit 58 has a significantly smaller diameter than conventional waste conduits, it can be installed where space is a premium. The smaller size of waste conduit 58 also provides other advantages. For example, the waste material flows through waste conduit at high velocity, and the waste conduit is left empty after every flush. This eliminates the build up of waste residual on the walls of the waste conduit.

While the above is a complete description of a preferred embodiment of the present invention, various modifications may be employed. For example, electronic sequencer 84 may be programmed to effect any desired sequence of operations that work for a particular application. Consequently, the scope of the invention should not be limited except as described in the claims.

What is claimed is:

1. A toilet comprising:

means for receiving pressurized water;

a toilet bowl in fluid communication with the water receiving means, the toilet bowl having a discharge opening for flowing waste material therefrom;

a water valve, coupled to the water receiving means, for selectively allowing water to flow into the toilet bowl;

a hopper in fluid communication with the discharge opening for receiving waste material therefrom;

a waste valve, disposed between the discharge opening and the hopper, for selectively allowing waste material to flow form the toilet bowl into the hopper;

waste receiving means including a waste conduit in fluid communication with the hopper for receiving waste material from the hopper;

means for receiving pressurized air;

a first air valve, disposed between the air receiving means and the hopper, for selectively allowing the pressurized air to flow into the hopper;

a second air valve fluid connected between the air receiving means and the waste conduit, for selectively allowing the pressurized air to flow into the waste conduit;

control means for selectively operating the water valve, the waste valve, the first air valve, and the second air valve so that waste flows form the toilet bowl to the waste receiving means;

. activation means for initiating operation of the control means;

the control means further including water valve control means, coupled to the water valve, for opening the water valve in response to the activation means and for closing the water valve after a selected water valve timing interval;

waste valve control means, coupled to the waste valve, for opening the waste valve in response to the activation means and for closing the waste valve after a selected waste valve timing interval;

first air valve control means, coupled to the first air valve, for opening the first air valve after the waste valve control means closes the waste control valve and for closing the first air valve after a selected first air valve timing interval; and second air valve control means, coupled to the second air valve, for opening the second air valve after the first air valve control means closes the first air valve and for closing the second air valve after a second air valve timing interval; and a check valve disposed in the waste conduit between the hopper and the connection between the second air valve and the waste conduit for preventing the flow of waste material from the waste conduit toward the hopper;

2. The toilet according to claim 1 further comprising a grinder having an inlet in fluid communication with the hopper and an outlet in fluid communication with the waste conduit.

3. The toilet according to claim 2 wherein the control means further comprises grinder control means, coupled to the grinder, for starting the grinder after the water valve control means opens the water valve and or stopping the grinder after a selected grinder timing interval.

4. The toilet according to claim 3 wherein the grinder control means starts the grinder after the waste valve control means closes the waste valve.

5. The toilet according to claim 1 wherein the water valve control means closes the water valve after the waste valve control means closes the waste valve.

6. The toilet according to claim 1 wherein the waste conduit has a diameter of less than one and one-quarter inch.

7. The toilet according to claim 6 wherein the waste conduit has a diameter of approximately one inch.

8. The toilet according to claim 7 wherein the waste receiving means includes a waste tank disposed above the toilet bowl.

9. The toilet according to claim 1 further comprising a third air valve disposed between the air receiving means and the water conduit for pressurizing the water flowing through the water conduit.

10. The toilet according o claim 1 wherein the activation means comprises a manually operated switch.

11. A toilet comprising;

water receiving means for receiving pressurized water;

a toilet bowl in fluid communication with the water receiving means, the toilet bowl having a discharge opening for flowing waste material therefrom;

a water valve, coupled to the water receiving means, for selectively allowing water to flow into the toilet bowl;

a hopper in fluid communication with the discharge opening for receiving waste material therefrom;

a waste valve, disposed between the discharge opening and the hopper, for selectively allowing waste material to flow from the toilet bowl into the hopper;

waste receiving means for receiving waste material from the hopper, the waste receiving means including a waste conduit having a diameter of less than one and one-quarter inch in fluid communication with the hopper and a waste tank disposed above the toilet bowl for receiving waste material flowing through the waste conduit;

a grinder having an inlet in fluid communication with the hopper and an outlet in fluid communication with the waste conduit;

air receiving means for receiving pressurized air;

a first air valve, disposed between the air receiving means and the hopper, for selectively allowing the pressurized air to flow into the hopper;

a second air valve, fluidly connected between the air receiving means and the waste conduit, for selectively allowing the pressurized air to flow into the waste conduit;

control means for selectively operating the water valve, the waste valve, the first air valve, and the second air valve so that waste flows form the toilet bowl to the waste receiving means;

activation means, coupled to the control means, for initiating operation of the control means;

the control means further including water valve control means, coupled to the water valve, for opening the water valve in response to the activation means and for closing the water valve after a selected water valve timing interval;

waste valve control means, coupled to the waste valve, for opening the waste valve in response to the activation means and for closing the waste valve after a selected waste valve timing interval;

first air valve control means, coupled to the first air valve, for opening the first air valve after the waste valve control means closes the waste control valve and for closing the first air valve after a selected first air valve timing interval;

second air valve control means, coupled to the second air valve, for opening the second air valve after the first air valve control means closes the first air valve and or closing the second air valve after a second air valve timing interval; and a check valve disposed in the waste conduit between the outlet of the grinder and the connection between the second air valve and the waste conduit for preventing the flow of waste material form the waste conduit toward the hopper.

12. The toilet according to claim 11 wherein the control means further comprises grinder control means, coupled to the grinder, for starting the grinder after the water valve control means opens the water valve and for stopping the grinder after a selected grinder timing interval.

13. The toilet according to claim 12 wherein the grinder control means starts the grinder after the waste valve control means closes the waste valve.

14. The toilet according to claim 11 wherein the water valve control mans closes the water valve after the waste valve control means closes the waste valve.

15. The toilet according o claim 11 further comprising a third air valve disposed between the air receiving means and the water conduit for pressurizing the water flowing through the water conduit.

* * * * *